US009922744B2

(12) United States Patent
Lettow

(10) Patent No.: US 9,922,744 B2
(45) Date of Patent: Mar. 20, 2018

(54) GRAPHENE-SULFUR COMPOSITIONS AND ELECTRODES MADE THEREFROM

(71) Applicant: John S. Lettow, Washington, DC (US)

(72) Inventor: John S. Lettow, Washington, DC (US)

( * ) Notice: Subject to any disclaimer, the term of this patent is extended or adjusted under 35 U.S.C. 154(b) by 592 days.

(21) Appl. No.: 13/676,914

(22) Filed: Nov. 14, 2012

(65) Prior Publication Data

US 2013/0119321 A1 May 16, 2013

Related U.S. Application Data

(60) Provisional application No. 61/559,152, filed on Nov. 14, 2011, provisional application No. 61/559,150, filed on Nov. 14, 2011.

(51) Int. Cl.

| | |
|---|---|
| ***H01B 1/02*** | (2006.01) |
| ***H01B 1/04*** | (2006.01) |
| ***H01B 1/08*** | (2006.01) |

(52) U.S. Cl.

CPC ..... *H01B 1/04* (2013.01); *H01B 1/08* (2013.01)

(58) Field of Classification Search

CPC ..... H01B 1/04

See application file for complete search history.

(56) References Cited

U.S. PATENT DOCUMENTS

2011/0111299 A1* 5/2011 Liu ..... B82Y 30/00 429/221

OTHER PUBLICATIONS

Ji, Liwen, et al, J. Am. Chem. Soc., Oct. 21, 2011, 133, 18522-25, with supporting information, pp. S1-S19.*

* cited by examiner

*Primary Examiner* — William Young

(74) *Attorney, Agent, or Firm* — Trentice V. Bolar, Esq.

(57) ABSTRACT

A method of making a composition, comprising: (1) oxidizing graphite to graphite oxide using at least one sulfur-containing reagent, (2) exfoliating the graphite oxide to form graphene sheets, and (3) blending the graphene sheets with elemental sulfur and/or at least one organosulfur compound, wherein the graphene sheets comprise at least about 1 weight percent sulfur. The composition may be made into an electrode that may be used in batteries, including lithium sulfur batteries.

12 Claims, No Drawings

GRAPHENE-SULFUR COMPOSITIONS AND ELECTRODES MADE THEREFROM

REFERENCE TO RELATED APPLICATIONS

The present application claims priority to U.S. Provisional Applications 61/559,152, filed on Nov. 14, 2011, and 61/559,150, filed on Nov. 14, 2011, the entire contents of which are hereby incorporated by reference.

FIELD OF THE INVENTION

The present invention relates to compositions comprising graphene sheets and sulfur, and electrodes made from the compositions.

BACKGROUND

The growing use of cordless devices such portable electronic devices and power tools as well as the increasing need for high capacity energy storage for uses such as electrical vehicles has driven significant research into rechargeable batteries having low cost, high energy storage capacity, and high specific power. One of the most promising and rapidly growing segments of the battery market is lithium-ion based batteries. However, these batteries can have limited energy densities.

An alternative to lithium ion batteries is lithium sulfur cells, which have significantly higher theoretical energy capacities. These cells have sulfur-containing cathodes. However, since sulfur is electrically insulating, it is desirable that it be in contact with an electrically conductive additive in the electrode to enable high current rate. It is also desirable that the sulfur posse a morphology that allows for rapid charge transfer. One challenge in the development of lithium sulfur cells is that lithium sulfide species can be generated in the cathodes and during discharge. If such species are soluble in the electrolytes, they can become electrochemically unavailable (such as if they migrate through the separator and to the anode, where they could react with the anode material). This can lead to disadvantages such as capacity fade, low cycle life, high self discharge rates, etc.

Ji et al. *Nature Mater.* 2009, 8, 500-506 discloses a highly ordered nanostructured carbon-sulfur cathode for lithium sulfur batteries. Yuan et al. *J. Power Sources* 2009, 189, 1141-1146 discloses sulfur-coated multi-walled carbon nanotube composites cathodes for lithium sulfur batteries. Wang et al. *Nano Lett.* 2011, 11, 2644 discloses graphene-wrapped sulfur particles as a rechargeable lithium-sulfur battery cathode material.

SUMMARY OF THE INVENTION

Disclosed and claimed herein is a method of making a composition, comprising: (1) oxidizing graphite to graphite oxide using at least one sulfur-containing reagent, (2) exfoliating the graphite oxide to form graphene sheets, and (3) blending the graphene sheets with elemental sulfur and/or at least one organosulfur compound, wherein the graphene sheets comprise at least about 1 weight percent sulfur.

Further disclosed and claimed is an electrode comprising a composition made by (1) oxidizing graphite to graphite oxide using at least one sulfur-containing reagent, (2) exfoliating the graphite oxide to form graphene sheets, and (3) blending the graphene sheets with elemental sulfur and/or at least one organosulfur compound, wherein the graphene sheets comprise at least about 1 weight percent sulfur, and a battery or capacitor comprising said electrode.

DETAILED DESCRIPTION OF THE INVENTION

The compositions made by the method of the present invention comprise compositions graphene sheets and sulfur and/or at least one organosulfur compound.

The sulfur may be in the form of elemental sulfur and present in any suitable form/allotropes. It may, for example, be one or more of octasulfur, $S_7$, $S_6$, $S_{12}$, $S_{18}$, other allotropes, etc.

The organosulfur compounds may be present as free molecules, covalently or non-covalently bound to the graphene sheets and/or elemental sulfur (referred to herein as "sulfur"), adsorbed onto the surface of the graphene sheets and/or elemental sulfur, absorbed into the graphene sheets and/or elemental sulfur, etc. The compounds may be present in more than one of these forms.

In some embodiments, the organosulfur compounds may be monomeric or oligomeric. They may have molecular weights of under about 1000 g/mol, or under about 500 g/mol. Examples of organosulfur compounds include thiols, disulfides, tetrasulfides, polysulfides, sulfuranes, persulfuranes, thioethers, thiesters, thioacetals, thioketones, thioaldehydes, thiocarboxylic acids, thioamides, etc.

The organosulfur compounds may be functionalized with groups that can react with graphene sheets and/or sulfur. Examples hydroxyl, amino, carboxylic acid and carboxylic acid derivatives, epoxy groups, etc. Examples of organosulfur compounds include Ω-mercaptocarboxylic acids, trialkoxysilyldisulfides and trialkoxysilyltetrasulfides, amino disulfides (such as cystamine, and bis-(4-aminophenyl) disulfide), carboxylic acid disulfides, amino acid disulfides (such as cystine and homocystine), alkylol disulfides (such as 2,2'-dithioethanol), w-thio alcohols (such as 4-mercapto-1-butanol), ω-thiocarboxylic acids (such as 3-mercaptopropionic acid), etc. The organosulfur compounds may be present in the form of a reaction product of an organosulfur compound such as one of the foregoing with graphene sheets and/or sulfur.

The graphene sheets are graphite sheets preferably having a surface area of from about 100 to about 2630 $m^2/g$. In some embodiments, the graphene sheets primarily, almost completely, or completely comprise fully exfoliated single sheets of graphite (these are approximately 1 nm thick and are often referred to as "graphene"), while in other embodiments, at least a portion of the graphene sheets may comprise at partially exfoliated graphite sheets, in which two or more sheets of graphite have not been exfoliated from each other. The graphene sheets may comprise mixtures of fully and partially exfoliated graphite sheets.

The graphene sheets are made by the exfoliation of graphite oxide (also known as graphitic acid or graphene oxide). The graphite oxide is made by the oxidation of graphite using a sulfur-containing reactant. The term "using a sulfur-containing reactant" does not necessarily mean that the sulfur-containing reactant is itself an oxidizing agent. It may mean that the sulfur containing reactant plays another role in the oxidation process.

The graphite oxide is preferably formed by oxidizing graphite using a system of one or more reagents, at least one of which is a chemical oxidizing agent. At least one sulfur-containing reagent is present in the system and which may or may not serve as the oxidizing agent. The system may comprise intercalating agents such as sulfuric acid.

Examples of oxidizing agents include nitric acid, sodium and potassium nitrates, perchlorates, hydrogen peroxide, permanganate salts (such a sodium or potassium permanganate), phosphorus pentoxide, bisulfites, etc. Preferred oxidants include $KClO_4$; $HNO_3$ and $KClO_3$; $KMnO_4$ and/or $NaMnO_4$; $KMnO_4$ and $NaNO_3$; $K_2S_2O_8$ and $P_2O_5$ and $KMnO_4$; $KMnO_4$ and $HNO_3$; and $HNO_3$. A preferred sulfur containing reagent is sulfuric acid.

Graphite that has been treated with a sulfur-containing intercalating agent such as sulfuric acid can be electrochemically oxidized.

The graphite oxide preferably comprises at least about 1 weight percent, or at least about 3 weight percent, or at least about 4 weight percent, or at least about 5 weight percent, or at least about 7 weight percent, or at least about 8 weight percent, or at least about 10 weight percent sulfur, as determined by elemental analysis.

The graphite oxide can be exfoliated using a variety of methods, including the ultrasonic exfoliation of suspensions or dispersions of the graphite oxide in suspension or by mechanical treatment (such as grinding or milling). Subsequently, the exfoliated graphite oxide can be reduced to graphene sheets.

The graphite oxide may be thermally exfoliated to form graphene sheets (also known as thermally exfoliated graphite oxide), as described in US 2007/0092432, the disclosure of which is hereby incorporated herein by reference. The thusly formed graphene sheets may display little or no signature corresponding to graphite or graphite oxide in their X-ray diffraction pattern.

The thermal exfoliation may be carried out in a continuous, semi-continuous batch, etc. process.

Heating can be done in a batch process or a continuous process and can be done under a variety of atmospheres, including inert and reducing atmospheres (such as nitrogen, argon, and/or hydrogen atmospheres). Heating times can range from under a few seconds or several hours or more, depending on the temperatures used and the characteristics desired in the final thermally exfoliated graphite oxide. Heating can be done in any appropriate vessel, such as a fused silica, mineral, metal, carbon (such as graphite), ceramic, etc. vessel. Heating may be done using a flash lamp. During heating, the graphite oxide may be contained in an essentially constant location in single batch reaction vessel, or may be transported through one or more vessels during the reaction in a continuous or batch mode. Heating may be done using any suitable means, including the use of furnaces and infrared heaters.

Examples of temperatures at which the thermal exfoliation of graphite oxide may be carried out are at least about 300° C., at least about 400° C., at least about 450° C., at least about 500° C., at least about 600° C., at least about 700° C., at least about 750° C., at least about 800° C., at least about 850° C., at least about 900° C., at least about 950° C., and at least about 1000° C. Preferred ranges include between about 750 about and 3000° C., between about 850 and 2500° C., between about 950 and about 2500° C., and between about 950 and about 1500° C.

The time of heating can range from less than a second to many minutes. For example, the time of heating can be less than about 0.5 seconds, less than about 1 second, less than about 5 seconds, less than about 10 seconds, less than about 20 seconds, less than about 30 seconds, or less than about 1 min. The time of heating can be at least about 1 minute, at least about 2 minutes, at least about 5 minutes, at least about 15 minutes, at least about 30 minutes, at least about 45 minutes, at least about 60 minutes, at least about 90 minutes, at least about 120 minutes, at least about 150 minutes, at least about 240 minutes, from about 0.01 seconds to about 240 minutes, from about 0.5 seconds to about 240 minutes, from about 1 second to about 240 minutes, from about 1 minute to about 240 minutes, from about 0.01 seconds to about 60 minutes, from about 0.5 seconds to about 60 minutes, from about 1 second to about 60 minutes, from about 1 minute to about 60 minutes, from about 0.01 seconds to about 10 minutes, from about 0.5 seconds to about 10 minutes, from about 1 second to about 10 minutes, from about 1 minute to about 10 minutes, from about 0.01 seconds to about 1 minute, from about 0.5 seconds to about 1 minute, from about 1 second to about 1 minute, no more than about 600 minutes, no more than about 450 minutes, no more than about 300 minutes, no more than about 180 minutes, no more than about 120 minutes, no more than about 90 minutes, no more than about 60 minutes, no more than about 30 minutes, no more than about 15 minutes, no more than about 10 minutes, no more than about 5 minutes, no more than about 1 minute, no more than about 30 seconds, no more than about 10 seconds, or no more than about 1 second. During the course of heating, the temperature may vary.

Examples of the rate of heating include at least about 120° C./min, at least about 200° C./min, at least about 300° C./min, at least about 400° C./min, at least about 600° C./min, at least about 800° C./min, at least about 1000° C./min, at least about 1200° C./min, at least about 1500° C./min, at least about 1800° C./min, and at least about 2000° C./min.

Graphene sheets may be annealed or reduced to graphene sheets having higher carbon to oxygen ratios by heating under reducing atmospheric conditions (e.g., in systems purged with inert gases or hydrogen). Reduction/annealing temperatures are preferably at least about 300° C., or at least about 350° C., or at least about 400° C., or at least about 500° C., or at least about 600° C., or at least about 750° C., or at least about 850° C., or at least about 950° C., or at least about 1000° C. The temperature used may be, for example, between about 750 about and 3000° C., or between about 850 and 2500° C., or between about 950 and about 2500° C.

The time of heating can be for example, at least about 1 second, or at least about 10 second, or at least about 1 minute, or at least about 2 minutes, or at least about 5 minutes. In some embodiments, the heating time will be at least about 15 minutes, or about 30 minutes, or about 45 minutes, or about 60 minutes, or about 90 minutes, or about 120 minutes, or about 150 minutes. During the course of annealing/reduction, the temperature may vary within these ranges.

The heating may be done under a variety of conditions, including in an inert atmosphere (such as argon or nitrogen) or a reducing atmosphere, such as hydrogen (including hydrogen diluted in an inert gas such as argon or nitrogen), or under vacuum. The heating may be done in any appropriate vessel, such as a fused silica or a mineral or ceramic vessel or a metal vessel. The materials being heated including any starting materials and any products or intermediates) may be contained in an essentially constant location in single batch reaction vessel, or may be transported through one or more vessels during the reaction in a continuous or batch reaction. Heating may be done using any suitable means, including the use of furnaces and infrared heaters.

The graphene sheets preferably have a surface area of at least about 100 $m^2/g$ to, or of at least about 200 $m^2/g$, or of at least about 300 $m^2/g$, or of least about 350 $m^2/g$, or of least about 400 $m^2/g$, or of least about 500 $m^2/g$, or of least about 600 $m^2/g$., or of least about 700 $m^2/g$, or of least about 800

$m^2/g$, or of least about 900 $m^2/g$, or of least about 700 $m^2/g$. The surface area may be about 400 to about 1100 $m^2/g$. The theoretical maximum surface area can be calculated to be 2630 $m^2/g$. The surface area includes all values and subvalues therebetween, especially including 400, 500, 600, 700, 800, 900, 1000, 1100, 1200, 1300, 1400, 1500, 1600, 1700, 1800, 1900, 2000, 2100, 2200, 2300, 2400, 2500, and 2630 $m^2/g$.

The graphene sheets can have number average aspect ratios of about 100 to about 100,000, or of about 100 to about 50,000, or of about 100 to about 25,000, or of about 100 to about 10,000 (where "aspect ratio" is defined as the ratio of the longest dimension of the sheet to the shortest).

Surface area can be measured using either the nitrogen adsorption/BET method at 77 K or a methylene blue (MB) dye method in liquid solution.

The dye method is carried out as follows: A known amount of graphene sheets is added to a flask. At least 1.5 g of MB are then added to the flask per gram of graphene sheets. Ethanol is added to the flask and the mixture is ultrasonicated for about fifteen minutes. The ethanol is then evaporated and a known quantity of water is added to the flask to re-dissolve the free MB. The undissolved material is allowed to settle, preferably by centrifuging the sample. The concentration of MB in solution is determined using a UV-vis spectrophotometer by measuring the absorption at $\lambda_{max}$=298 nm relative to that of standard concentrations.

The difference between the amount of MB that was initially added and the amount present in solution as determined by UV-vis spectrophotometry is assumed to be the amount of MB that has been adsorbed onto the surface of the graphene sheets. The surface area of the graphene sheets are then calculated using a value of 2.54 $m^2$ of surface covered per one mg of MB adsorbed.

In some embodiments, the graphene sheets may have a bulk density of from about 0.01 to at least about 200 $kg/m^3$. The bulk density includes all values and subvalues therebetween, especially including 0.01, 0.5, 1, 5, 10, 15, 20, 25, 30, 35, 50, 75, 100, 125, 150, and 175 $kg/m^3$.

The graphene sheets may be functionalized with, for example, oxygen-containing functional groups (including, for example, hydroxyl, carboxyl, and epoxy groups) and typically have an overall carbon to oxygen molar ratio (C/O ratio), as determined by elemental analysis of at least about 1:1, or more preferably, at least about 3:2. Examples of carbon to oxygen ratios include about 3:2 to about 85:15; about 3:2 to about 20:1; about 3:2 to about 30:1; about 3:2 to about 40:1; about 3:2 to about 60:1; about 3:2 to about 80:1; about 3:2 to about 100:1; about 3:2 to about 200:1; about 3:2 to about 500:1; about 3:2 to about 1000:1; about 3:2 to greater than 1000:1; about 10:1 to about 30:1; about 80:1 to about 100:1; about 20:1 to about 100:1; about 20:1 to about 500:1; about 20:1 to about 1000:1; about 50:1 to about 300:1; about 50:1 to about 500:1; and about 50:1 to about 1000:1. In some embodiments, the carbon to oxygen ratio is at least about 10:1, or at least about 20:1, or at least about 35:1, or at least about 50:1, or at least about 75:1, or at least about 100:1, or at least about 200:1, or at least about 300:1, or at least about 400:1, or at least 500:1, or at least about 750:1, or at least about 1000:1; or at least about 1500:1, or at least about 2000:1. The carbon to oxygen ratio also includes all values and subvalues between these ranges.

The graphene sheets may contain atomic scale kinks. These kinks may be caused by the presence of lattice defects in, or by chemical functionalization of the two-dimensional hexagonal lattice structure of the graphite basal plane.

The graphene sheets may be electrically conductive. In some embodiments, the surface resistivity of the graphene sheets may be no greater than about 10000 Ω/square, or no greater than about 5000 Ω/square, or no greater than about 1000 Ω/square, or no greater than about 700 Ω/square, or no greater than about 500 Ω/square, or no greater than about 350 Ω/square, or no greater than about 200 Ω/square, or no greater than about 200 Ω/square, or no greater than about 150 Ω/square, or no greater than about 100 Ω/square, or no greater than about 75 Ω/square, or no greater than about 50 Ω/square, or no greater than about 30 Ω/square, or no greater than about 20 Ω/square, or no greater than about 10 Ω/square, or no greater than about 5 Ω/square, or no greater than about 1 Ω/square, or no greater than about 0.1 Ω/square, or no greater than about 0.01 Ω/square, or no greater than about 0.001 Ω/square.

The graphene sheets may have an electrical conductivity of at least about $10^{-8}$ S/m. They can have a conductivity of about $10^{-6}$ S/m to about $10^5$ S/m, or of about $10^{-5}$ S/m to about $10^5$ S/m. In other embodiments of the invention, the graphene sheets have conductivities of at least about 0.001 S/m, of at least about 0.01 S/m, of at least about 0.1 S/m, of at least about 1 S/m, of at least about 10 S/m, of at least about 100 S/m, or at least about 1000 S/m, or at least about 10,000 S/m, or at least about 20,000 S/m, or at least about 30,000 S/m, or at least about 40,000 S/m, or at least about 50,000 S/m, or at least about 60,000 S/m, or at least about 75,000 S/m, or at least about $10^5$ S/m, or at least about $10^6$ S/m.

In some embodiments, the graphene sheets can have a thermal conductivity of about 0.1 to about 50 W/(m-K), or of about 0.5 to about 30 W/(m-K), or of about 1 to about 30 W/(m-K), or of about 1 to about 20 W/(m-K), or of about 1 to about 10 W/(m-K), or of about 1 to about 5 W/(m-K), or of about 2 to about 25 W/(m-K), or of about 5 to about 25 W/(m-K).

After exfoliation and/or annealing, the graphene sheets comprise at least about 1 weight percent, or at least about 3 weight percent, or at least about 4 weight percent, or at least about 5 weight percent, or at least about 7 weight percent, or at least about 8 weight percent, or at least about 10 weight percent sulfur, as determined by elemental analysis.

The graphene sheets may be in the form of strips or tapes. Examples of tapes include those that can be made by forming a film comprising graphene sheets and at least one polymer binder and heating the film to decompose the binder.

The films may be prepared by a solution processing method. Suspensions comprising graphene sheets, a solvent, at least one polymer binder, and optionally at least one surfactant may be applied to a substrate using any suitable process, including a doctor blade method, casting, spin casting, spin coating, dip coating, printing, spray coating, electrospraying, etc. The solvent may then be removed by drying or evaporation, by polymerizing or curing (such as by light, heat, etc.), and/or any other suitable method. The film is heated to decompose the binder (and surfactant, if used) and form the tape. After decomposition, preferably no more than about 60 percent, or no more than about 50 percent, or no more than about 40 percent, or no more than about 25 percent, or no more than about 20 percent, or no more than about 15 percent, or no more than about 10 percent, or no more than about 5 percent of the original binder and surfactant (if present) mass remains in the tapes. The amount of binder (and surfactant if present) remaining can be determined by measuring loss in mass of the tape relative to that of the precursor film.

The graphene sheets may be cross-linked by, for example covalently bound tethers, etc., to each other prior to being combined with the binder (or binder precursors), or they may be held together by covalent bound tethers without the need for an extra binder. They may also be cross-linked after they have been combined, during solvent removal, and/or during heating.

In some embodiments, the graphene sheets may comprise about 5 to about 70 weight percent, or about 5 to about 60 weight percent, or about 5 to about 50 weight percent, or about 10 to about 45 weight percent of the total amount of graphene sheets, binder, and surfactant (if used).

Examples of substrates include glass, including glass that has been surface treated (such as with a silane) to facilitate removal of the films or tapes, silicon, metals (such as for electrode applications), polymers, solid or gel electrolytes, etc. Examples of solvents include water (including water at various pHs), alcohols (such as methanol, ethanol, propanol, etc.), chlorinated solvents (such as methylene chloride, chloroform, carbon tetrachloride, etc.), tetrahydrofuran, dimethylformamide, N-methylpyrrolidone, gamma-butyrolactone, etc.

The suspensions may further comprise surfactants such as poly(ethylene oxide)s, poly(propylene oxide)s, ethylene oxide/propylene oxide copolymers (including block copolymers), gum arabic, poly(vinyl alcohol), ionic surfactants, sulfates (sulfates (such as alkyl sulfates (including ammonium lauryl sulfate, sodium lauryl sulfate (SDS) and alkyl ether sulfates (such as sodium laureth sulfate)), sulfonates, phosphates (including alkyl aryl ether phosphates and alkyl ether phosphates), carboxylates, cationic amines, quaternary ammonium cations, etc.

Examples of polymeric binders include polysiloxanes (such as poly(dimethylsiloxane), dimethylsiloxane/vinylmethylsiloxane copolymers, vinyldimethylsiloxane terminated poly(dimethylsiloxane), etc.), polyethers and glycols such as poly(ethylene oxide)s (also known as poly(ethylene glycol)s, poly(propylene oxide)s (also known as poly(propylene glycol)s, and ethylene oxide/propylene oxide copolymers (including block copolymers), cellulosic resins (such as ethyl cellulose, ethyl hydroxyethyl cellulose, carboxymethyl cellulose, cellulose acetate, cellulose acetate propionates, and cellulose acetate butyrates), and poly(vinyl butyral), polyvinyl alcohol and its derivatives, poly(vinyl acetate), ethylene/vinyl acetate polymers, acrylic polymers and copolymers (such as methyl methacrylate polymers, methacrylate copolymers, polymers derived from one or more acrylates, methacrylates, ethyl acrylates, ethyl methacrylates, butyl acrylates, butyl methacrylates and the like), styrene/acrylic copolymers, styrene/maleic anhydride copolymers, isobutylene/maleic anhydride copolymers, vinyl acetate/ethylene copolymers, ethylene/acrylic acid copolymers, polyolefins, polystyrenes, olefin and styrene copolymers, epoxy resins, acrylic latex polymers, rubbers, natural rubbers, butyl rubbers, nitrile rubbers, polyester acrylate oligomers and polymers, polyester diol diacrylate polymers, UV-curable resins, polyamides, etc.

Suspensions containing polymerizable monomers and/or oligomers may also be used, wherein at least a portion of the polymer binder is formed by polymerizing the monomers and/or oligomers in the presence of the graphene sheets. In such cases the monomers and/or oligomers can serve as some or all of the solvent.

Suitable decomposition heating temperatures are at least about 150° C. The film may also be heated at at least about 200° C., at at least about 300° C., at at least about 400° C., at at least about 500° C., at least about 750° C., at at least about 1000° C., at at least about 1100° C., at at least about 1200° C., at at least about 1300° C., at at least about 1500° C., at at least about 2000° C., at at least about 2200° C., between about 300 and 750° C., between about 300 and 1000° C., between about 750 and 1500° C., and between about 950 and about 2000° C. Higher heating temperatures often lead to tapes with increased electrical conductivity and decreased mechanical properties.

Heating may be done in any suitable vessel (including furnaces) and preferably under a non-oxidizing atmosphere such as nitrogen or argon.

The tapes may be further annealed by heating after the binder is decomposed. At temperatures above about 1500° C., healing of certain graphene lattice defects may occur.

The films may be peeled off the substrate prior to the binder decomposition step or after the tapes have been formed.

In some embodiments, the films and tapes may have a thickness of about 0.1 micron to about 1 micron, or about 0.1 microns to about 1 mm, or about 1 micron to about 1 mm, or about 1 micron to about 500 microns, or about 5 microns to about 500 microns, or about 10 microns to about 100 microns, or about 20 microns to about 75 microns, or about 30 microns to about 60 microns. Thicker films may be formed by coating one or more additional layers over an already formed film or tape.

The tapes are preferably free-standing, self-supporting materials that may be handled unattached to a substrate or other backing materials. Free-standing tapes may be attached to other materials, including surface, substrates, backing materials, etc. when used in certain applications.

There are no particular limitations to the length and width of the tapes. They may be cut or otherwise formed into any desired shape. They may be sufficiently flexible to be bent at an angle of at least about 90° without breaking. In some cases they may be sufficiently flexible to bent at an angle of at least about 150° without breaking. The radius of curvature may be less than about 1 cm.

The tapes can have a density of about 0.05 to about 1 $g/cm^3$, or about 0.1 to about 0.6 $g/cm^3$. The tapes can have a surface area of at least about 30 $m^2/g$, or at least about 50 $m^2/g$, or at least about 100 $m^2/g$, or at least about 150 $m^2/g$, or at least about 200 $m^2/g$, or at least about 300 $m^2/g$, or at least about 400 $m^2/g$, or at least about 500 $m^2/g$, or at least about 700 $m^2/g$. Surface area can be measured as described above using either the nitrogen adsorption/BET method at 77 K or a methylene blue (MB) dye method in liquid solution.

The tapes can have carbon to oxygen ratios in the same ranges as those described above for the graphene sheets.

The composition may contain one or more additional additives. Other additives include electrically conductive additives, such as additional carbonaceous materials, metals (including metal alloys), conductive metal oxides, polymers, metal-coated materials, etc. These components can take a variety of forms, including particles, powders, flakes, foils, needles, wires, nanoparticles, nanowires, etc.

Examples of carbonaceous materials include, but are not limited to, graphite (including natural, Kish, and synthetic, annealed, pyrolytic, highly oriented pyrolytic, etc. graphites), graphitized carbon, carbon black, mesoporous carbon, carbon fibers and fibrils, carbon whiskers, vapor-grown carbon nanofibers, metal coated carbon fibers, carbon nanotubes (including single- and multi-walled nanotubes), fullerenes, activated carbon, carbon fibers, expanded graphite, expandable graphite, graphite oxide, hollow carbon spheres, carbon foams, etc.

Examples of metals include, but are not limited to silver, copper, aluminum, platinum, palladium, nickel, chromium, gold, bronze, colloidal metals, etc. Examples of metal oxides include antimony tin oxide and indium tin oxide and materials such as fillers coated with metal oxides. Metal and metal-oxide coated materials include, but are not limited to metal coated carbon and graphite fibers, metal coated glass fibers, metal coated glass beads, metal coated ceramic materials (such as beads), etc. These materials can be coated with a variety of metals, including nickel.

Examples of electrically conductive polymers include, but are not limited to, polyacetylene, polyethylene dioxythiophene (PEDOT), poly(styrenesulfonate) (PSS), PEDOT:PSS copolymers, polythiophene and polythiophenes, poly(3-alkylthiophenes), poly(2,5-bis(3-tetradecylthiophen-2-yl)thieno[3,2-b]thiophene) (PBTTT), poly(phenylenevinylene), polypyrene, polycarbazole, polyazulene, polyazepines, polyflurorenes, polynaphthalene, polyisonaphthalene, polyanilines, polypyrroles, poly(phenylene sulfide), polycarbozoles, polyindoles, polyphenylenes, copolymers of one or more of the foregoing, etc., and their derivatives and copolymers. The conductive polymers may be doped or undoped. They may be doped with boron, phosphorous, iodine, etc.

The compositions may further contain one or more binders, such as poly(ethylene oxide) (PEO), poly(propylene oxide) (PPO), ethylene oxide/propylene oxide copolymers (PEO/PPO), poly(tetrafluoroethylene), other fluoropolymers, etc. Binders (such PEO, PPO, PEO/PPO, etc.) can be grafted onto the surface of the graphene sheets.

The electrode compositions may be formed using any suitable method. The graphene sheets, elemental sulfur and/or organosulfur, and any optional components may be combined at one time or in a stepwise fashion.

The graphene sheets may be blended with molten elemental sulfur. Two or more components may be combined in a dispersion, suspension, solution, etc. in a carrier such as water. The mixtures may be blended using stirring, ultrasonication, media milling, etc. The dispersion, suspension, solution, etc. may further contain other additives such as surfactants (such as poly(ethylene glycol)). The components may be formed into a paste. Components may be blended by milling, such as in a ball mill, media mill, roller, mixer, etc.

In a case of where the graphene sheets are partially or fully in the form of tapes, the elemental sulfur and/or organosulfur, and other additives (if present) may also be incorporated at one or more points during the preparation of the tapes.

The elemental sulfur may be in any suitable form, including particles. Sulfur particles may be formed using any suitable method, including by the precipitation products of reactions of sulfur-containing salts. An example is the reaction of sodium thiosulfate with hydrochloric acid. Particles may have any suitable size, and include those having d50 particle sizes in the nanometer and micron ranges.

In some embodiments, the graphene sheets and sulfur and/or organosulfur compounds may be present in a weight ratio of about 0.1 to about 95; about 0.5 to about 95; about 1 to about 95; about 2 to about 95; about 5 to about 95; about 10 to about 90; about 15 to about 85; about 20 to about 80; about 25 to about 75; about 30 to about 70; about 35 to about 65; about 40 to about 60; about 45 to about 55; about 50 to about 50; about 55 to about 45; and about 60 to about 40, respectively.

In some embodiments, when other carbonaceous additives are present, the graphene sheets plus other carbonaceous additives and organosulfur compound and/or sulfur may be present in a weight ratio of about 0.1 to about 95; about 0.5 to about 95; about 1 to about 95; about 2 to about 95; of about 5 to about 95; about 10 to about 90; about 15 to about 85; about 20 to about 80; about 25 to about 75; about 30 to about 70; about 35 to about 65; about 40 to about 60; about 45 to about 55; about 50 to about 50; about 55 to about 45; and about 60 to about 40, respectively.

The compositions may be formed into electrodes for energy storage devices, such as batteries, capacitors, and ultracapacitors. A preferred electrode is a cathode. The electrodes may be incorporated into a battery, capacitor, ultracapacitor (supercapacitor), or other energy storage device.

A preferred battery is a lithium sulfur battery. Suitable anode materials for the lithium sulfur battery include lithium metal, graphite, lithium titanate, tin, tin oxides, silicon, silicon oxides, etc. Suitable electrolyte components include ionic liquids and one or more lithium salts such as lithium hexafluorophosphate, lithium bis-trifluoromethanesulfonamide, etc. Suitable components also include one or more solvents such as ethyl methyl sulphone, dimethoxyethane, dioxolane, etc.

The batteries may be used in any suitable equipment, apparatus, device. Examples include portable electronic devices such as computers, cellular telephones, games, navigation systems, personal digital assistants, music players, games, calculators, radios, touch pad devices, artificial "paper" and reading devices, etc. The batteries may be used in vehicles, such as electric and hybrid vehicles (including cars, trucks, minivans, SUVs, buses, snowmobiles, all-terrain vehicles, motorcycles, mopeds, electric bicycles, scooters, submersibles, tanks etc.). They may be used in power tools, landscaping equipment (such as lawnmowers, trimmers, edgers, etc.), chain saws, etc. They may be used in lighting devices (such as flash lights, spot lights, flood lights, etc.), military equipment, night vision goggles, rangefinders, target identifiers, etc.

The invention claimed is:

1. A method of making an electrode composition, comprising:

oxidizing graphite to graphite oxide using at least one sulfur-containing reagent;

exfoliating the graphite oxide to form graphene sheets;

blending the graphene sheets, a solvent, a binder, and sulfur to form a suspension;

applying the suspension to a substrate;

removing a quantity of the solvent from the suspension;

removing the suspension from the substrate;

heating the suspension to decompose the binder thereby forming a free-standing, self-supporting material; and wherein the graphene sheets completely comprise fully exfoliated single sheets of graphene;

are approximately 1 nm thick;

display no signature corresponding to graphite or graphite oxide in their X-ray diffraction pattern; and comprise at least about 1 weight percent sulfur.

2. The method of claim 1, wherein the step of exfoliating the graphite oxide comprises thermally exfoliating the graphite oxide to form the graphene sheets.

3. The method of claim 1, wherein the graphene sheets comprise about 5 to about 70 weight percent of the total amount of the graphene sheets and binder.

4. The method of claim 1, further comprising cross-linking the graphene sheets.

5. The method of claim 1, wherein the sulfur-containing reagent is sulfuric acid.

6. The method of claim 1, wherein the graphite is oxidized to graphite oxide using a mixture comprising sulfuric acid and at least permanganate salt.

7. The method of claim 1, wherein the graphene sheets have a surface area of at least about 100 $m^2/g$.

8. The method of claim 1, wherein the step of heating the suspension to decompose the binder results in no more than 60% of the binder by mass remaining after the decomposition.

9. The method of claim 1, wherein the free-standing, self-supporting material is formed in a manner to comprise a radius of curvature of less than 1 cm when bent.

10. The method of claim 1, wherein the sulfur comprises elemental sulfur formed by reacting sodium thiosulfate with hydrochloric.

11. The method of claim 10, wherein the sulfur comprises a d50 particle size.

12. The method of claim 1, wherein the graphene sheets have a carbon to oxygen molar ratio of at least about 50:1.

* * * * *